US008171927B2

(12) United States Patent
Pryor et al.

(10) Patent No.: US 8,171,927 B2
(45) Date of Patent: May 8, 2012

(54) BURNER CAP FLAME STABILIZATION CHAMBER

(75) Inventors: William M. Pryor, Portland, TN (US); Uwe Harneit, Chino Hills, CA (US); Hector J. Donastorg, Waverly, AL (US); Michael Padgett, Austin, KY (US); John Pottenger, Herdersonville, TN (US)

(73) Assignee: Electrolux Home Products, Inc., Charlotte, NC (US)

( * ) Notice: Subject to any disclaimer, the term of this patent is extended or adjusted under 35 U.S.C. 154(b) by 674 days.

(21) Appl. No.: 11/862,712

(22) Filed: Sep. 27, 2007

(65) Prior Publication Data

US 2009/0087804 A1 Apr. 2, 2009

(51) Int. Cl.
*F24C 3/00* (2006.01)
*F23D 14/58* (2006.01)

(52) U.S. Cl. ..... 126/39 E; 431/349; 431/286

(58) Field of Classification Search ..... 431/349, 431/354, 286, 350, 193; 126/39 E, 39 R, 126/41 R See application file for complete search history.

(56) References Cited

U.S. PATENT DOCUMENTS

| | | | | |
|---|---|---|---|---|
| 3,796,535 | A | 3/1974 | De Gouville | |
| 4,757,801 | A | 7/1988 | Le Monnier de Gouville et al. | |
| 5,133,658 | A * | 7/1992 | Le Monnier De Gouville et al. | 431/349 |
| 5,246,365 | A * | 9/1993 | Himmel et al. | 431/263 |
| 5,408,984 | A | 4/1995 | Maughan | |
| 5,464,004 | A | 11/1995 | Maughan | |
| 5,488,942 | A | 2/1996 | Maughan | |
| 5,690,483 | A | 11/1997 | Oda et al. | |
| 5,800,159 | A | 9/1998 | Maughan et al. | |
| 5,899,681 | A * | 5/1999 | Maughan | 431/8 |
| 6,135,764 | A * | 10/2000 | Kwiatek | 431/266 |
| 6,146,132 | A * | 11/2000 | Harneit | 431/354 |
| 6,371,754 | B1 * | 4/2002 | Haynes | 431/286 |
| 7,614,877 | B2 * | 11/2009 | McCrorey et al. | 431/354 |
| 7,650,882 | B2 * | 1/2010 | Little et al. | 126/215 |

FOREIGN PATENT DOCUMENTS

| | | | |
|---|---|---|---|
| EP | 0851174 | | 7/1998 |
| EP | 1114966 | | 7/2001 |
| GB | 2153988 | A * | 2/1984 |
| JP | 05203119 | | 8/1993 |
| JP | 2000346312 | | 12/2000 |
| JP | 2006029723 | | 2/2006 |

OTHER PUBLICATIONS

International Search Report for PCT/US2008/077368, dated Jun. 19, 2009, 3 pages.

* cited by examiner

*Primary Examiner* — Kenneth Rinehart
*Assistant Examiner* — Chuka C Ndubizu
(74) *Attorney, Agent, or Firm* — Pearne & Gordon LLP

(57) ABSTRACT

A gas burner cap for a cooking appliance includes a top side and a bottom side. The bottom side of the cap is configured to face a corresponding burner body. One or more flame-stabilization chambers are located on the bottom side of the cap.

19 Claims, 6 Drawing Sheets

BURNER CAP FLAME STABILIZATION CHAMBER

BACKGROUND OF THE INVENTION

1) Field of the Invention

The present invention relates to burner caps, and more particularly, to a burner cap used on a gas cooktop and having a flame stabilization chamber therein.

2) Description of Prior Art

Atmospheric gas burners are commonly used as surface units in household gas cooking appliances. A significant factor in the performance of gas burners is their ability to withstand airflow disturbances in the surroundings, such as room drafts, rapid movement of cabinet doors, and most commonly rapid oven door manipulation. Manipulation of the oven door is particularly troublesome because rapid openings and closings of the oven door often produce respective under-pressure and over-pressure conditions within the range body. Since the flue, through which combustion products are removed from the oven, is sized to maintain the desired oven temperature and is generally inadequate to supply a sufficient airflow for re-equilibration, a large amount of air passes through or around the gas burners.

This surge of air around the gas burners is detrimental to the flame stability of the burners and may cause extinction of the flames. This flame stability problem is particularly evident in sealed gas burner arrangements, referring to the lack of an opening in the cooktop surface around the base of the burner to prevent spills from entering the area beneath the cooktop.

The inherent cause of this flame instability is the low pressure drop of the gas-air mixture passing through the burner ports of a typical rangetop burner. Although there is ample pressure available in the fuel, the pressure energy is used to accelerate the fuel to the high injection velocity required for primary air entrainment. Relatively little of this pressure is recovered at the burner ports. A low pressure drop across the ports allows pressure disturbances propagating through the ambient to easily pass through the ports, momentarily drawing the flame towards the burner head and leading to thermal quenching and extinction.

An additional problem is that rapid adjustments of the fuel supply to a gas burner from a high burner input rate to a low burner input rate often will cause flame extinction when the momentum of the entrained air flow continues into the burner even though fuel has been cut back, resulting in a momentary drop in the gas-air ratio, causing extinction.

SUMMARY OF THE INVENTION

The following presents a simplified summary of the invention in order to provide a basic understanding of some aspects of the invention. This summary is not an extensive overview of the invention. It is intended to neither identify key or critical elements of the invention nor delineate the scope of the invention. Its sole purpose is to present some concepts of the invention in a simplified form as a prelude to the more detailed description that is presented later.

In accordance with an aspect of the present invention, a gas burner cap for a cooking appliance is provided. The gas burner cap includes a top side and a bottom side. The bottom side of the cap is configured to face a corresponding burner body. One or more flame-stabilization chambers are located on the bottom side of the cap.

In accordance with another aspect of the present invention, a gas burner assembly is provided. The gas burner assembly includes a burner body having a top side and a bottom side; and a burner cap having a top side and a bottom side, the bottom side of the cap being configured to couple with the top side of the burner body, wherein the burner cap includes at least one flame-stabilization chamber on the bottom side of the cap, the flame-stabilization chamber being configured to retain a gas-air mixture therein.

In accordance with yet another aspect of the present invention, a gas burner cap for a cooking appliance is provided. The gas burner cap includes means for contacting a corresponding burner body; and means for retaining an air-gas mixture therein to facilitate flame stabilization when a pressure disturbance occurs in the cooking appliance.

The following description and the annexed drawings set forth in detail certain illustrative aspects of the invention. These aspects are indicative, however, of but a few of the various ways in which the principles of the invention may be employed and the present invention is intended to include all such aspects and their equivalents. Other objects, advantages and novel features of the invention will become apparent from the following detailed description of the invention when considered in conjunction with the drawings.

BRIEF DESCRIPTION OF THE DRAWINGS

The foregoing and other features and advantages of the present invention will become apparent to those skilled in the art to which the present invention relates upon reading the following description with reference to the accompanying drawings.

DESCRIPTION OF AN EXAMPLE EMBODIMENT

Figure 1:
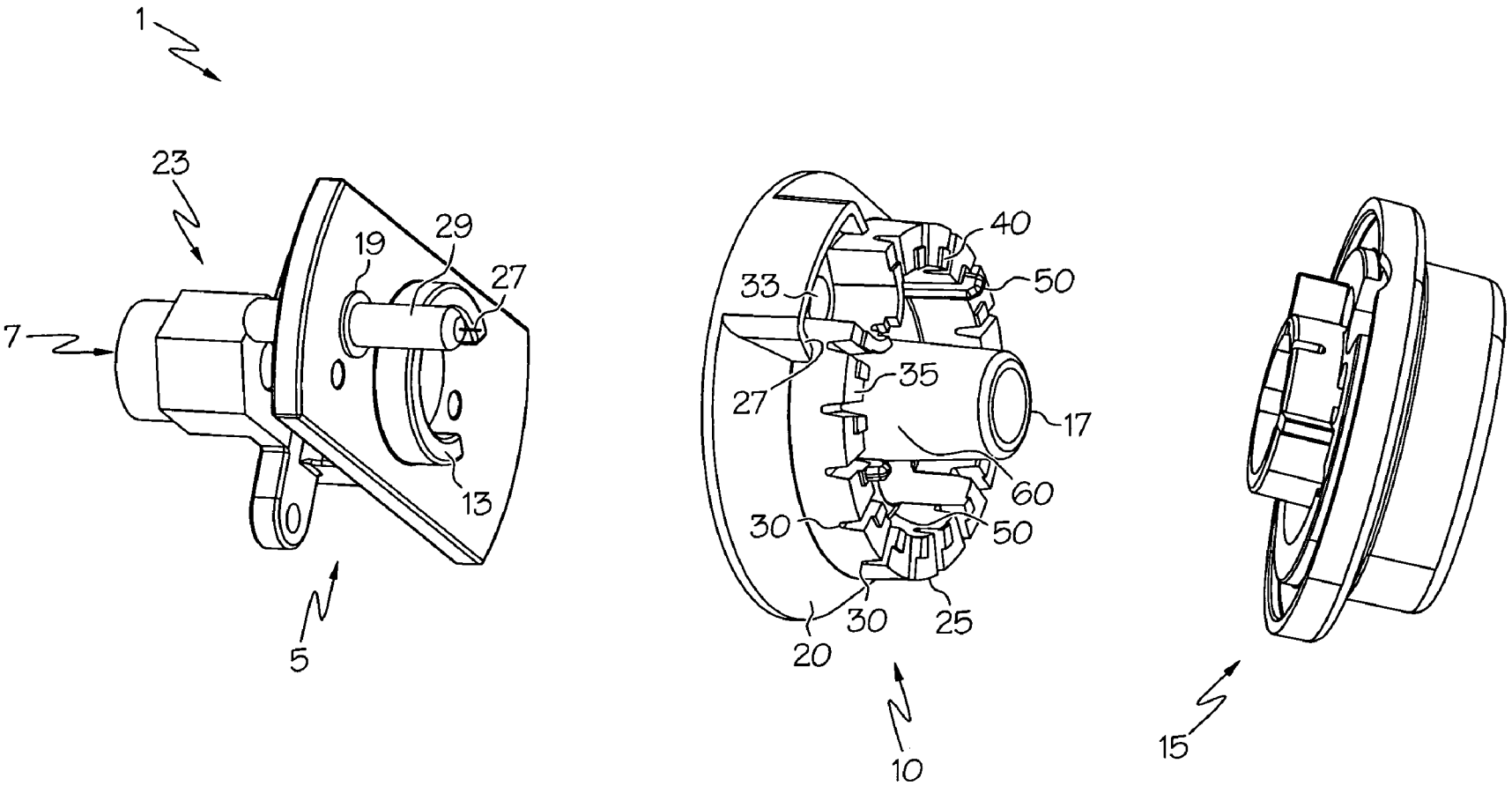
FIG. 1 illustrates an exploded view of a burner assembly in accordance with an aspect of the present invention.

The present invention relates to a cap for a burner having at least one flame-stabilization chamber provided therein. Each flame-stabilization chamber serves to retain a modicum of the gas-air mixture that is combusted in the burner, and the chamber is located within the burner cap such that the gas-air mixture it retains is relatively isolated from the main chamber or plenum that contains the gas-air mixture that is delivered to the burner ports. As a result, when a pressure change occurs at the burner, such as might take place when an oven door is opened or closed, resulting in a disturbance to the burner flame, the gas-air mixture in the flame-stabilization chamber is available to stabilize the flame. The present invention will now be described with reference to the drawings, wherein like reference numerals are used to refer to like elements throughout. It is to be appreciated that the various drawings are not drawn to scale from one figure to another nor inside a given figure, and in particular that the size of the components are arbitrarily drawn for facilitating the reading of the drawings. In the following description, for purposes of explanation, numerous specific details are set forth in order to provide a thorough understanding of the present invention. It may be evident, however, that the present invention may be practiced without these specific details.

Figure 2:
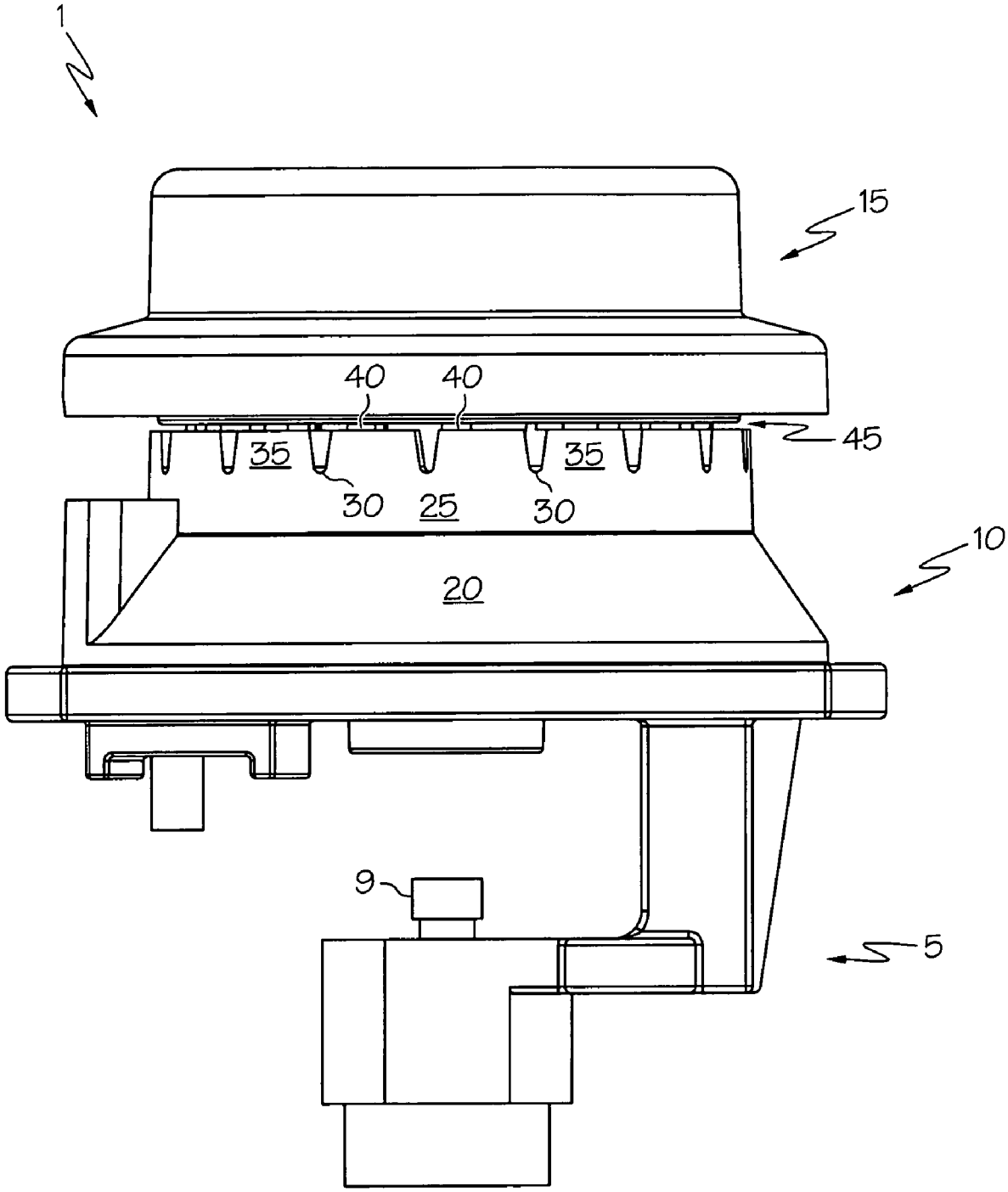
FIG. 2 illustrates the burner assembly of FIG. 1, as assembled, in accordance with an aspect of the present invention.

Referring initially to FIGS. 1 and 2, exploded and assembled views of a burner assembly 1 are depicted in accordance with an aspect of the present invention. The burner assembly 1 includes a support member 5, a burner body 10 and a burner cap 15. The support member 5 includes a gas inlet 7 and is configured for attachment to a fuel supply (not shown). An orifice fitting 9 is secured to the support member 5 and is in fluid communication with the gas inlet 7. The support member 5 also provides support for the burner body 10. Specifically, the support member 5 includes a cylindrical projection 13 on a top surface thereof. The cylindrical projection 13 is configured to receive a downwardly extending portion of an annular boss 17, which is provided through a central portion of the burner body 10. Thus, the orifice fitting 9 can provide a gas supply jet into the annular boss 17. The support member 5 further includes an aperture 19 for receiving a spark ignition assembly 23. The spark ignition assembly 23 includes a spark electrode or wire 27 formed of electrically conductive material for connection to a source of high voltage potential and an insulation member 29, such as a ceramic material. A lower portion of the spark ignition assembly extends below a gas cooktop surface for connecting the spark electrode to a high voltage potential. An upper portion of the spark ignition assembly is received through an aperture 33 in the burner body 10 such that the upper portion of the spark electrode is positioned within an ignition chamber 55 formed in the burner body 10.

Figure 3:
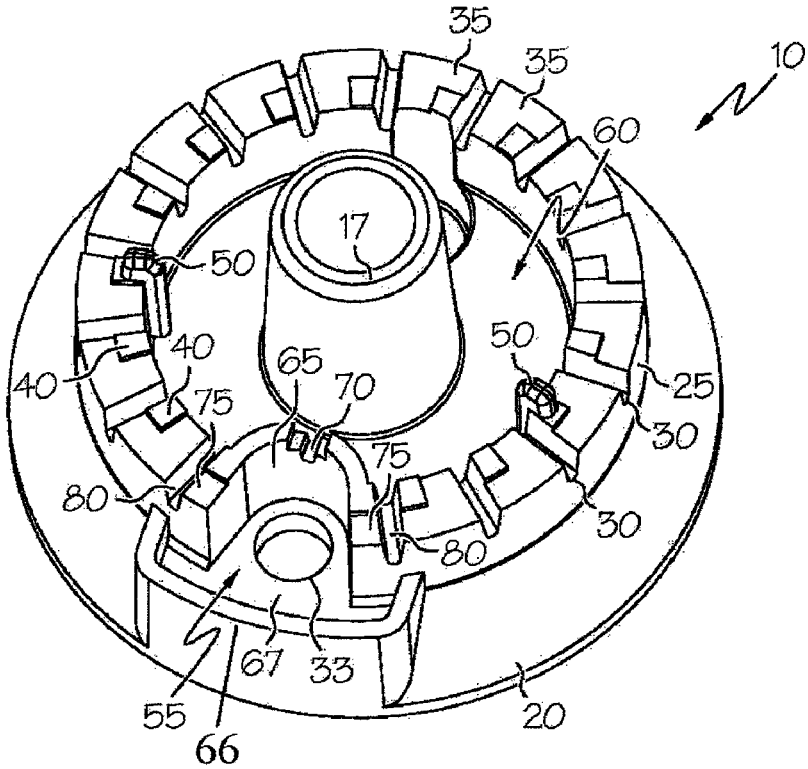
FIG. 3 illustrates a top side of a burner body in accordance with an aspect of the present invention.

FIG. 3 depicts the burner body 10 in greater detail. The burner body 10 includes a frustum-shaped base 20 and a cylindrical sidewall 25 extending axially from the base 20. A plurality of flame ports 30 are provided in a top portion of the cylindrical sidewall 25 to form a plurality of burner teeth 35, each burner tooth 35 being positioned between two adjacent flame ports 30. The flame ports 30 are generally u-shaped with the opening of the u-shape being slightly wider than the base. However, it is to be appreciated that any suitable shaped and sized port opening can be provided to support a flame therethrough. A main fuel chamber 60 is provided for fluid communication with each of the flame ports 30. Each burner tooth 35 includes at least one crossover spacer 40 extending axially from a top surface of the tooth 35. The crossover spacers 40 are configured to contact a corresponding portion of the burner cap 15 to allow a crossover flame to pass through slots 45 (FIG. 2) formed between the burner cap 15 and top surfaces of the burner teeth 35. The slots 45 provide a small amount of gas around the entire circumference of the burner body 10, which is used as crossover lighting on low flow. The present example shows the crossover spacers 40 as square-shaped protrusions located at inner corner areas of the teeth 35. However, the crossover spacers and slots can be of any suitable desired shape and size and can be provided at any suitable location as long as the crossover spacers 40 keep the burner cap 15 from directly contacting the tops of the burner teeth 35.

The burner body 10 also includes at least one locator 50 extending therefrom in order to properly orient the burner cap 15 on the burner body 10. In the illustrated example, two locators 50 coupled to corresponding burner teeth 35 are illustrated; however, any suitable number or shaped locators can be employed. Moreover, locator(s) can be provided at any suitable location on the burner body 10. Alternatively, or additionally, the locator(s) can be provided on the burner cap 15 and is contemplated as falling within the scope of the present invention.

The burner body 10 further includes an ignition chamber 55 formed therein. The ignition chamber 55 is defined by a substantially u-shaped wall 65 on one side and a substantially straight wall 66 on an opposing side. The bottom of the ignition chamber 55 is defined by a surface 67 of the burner body 10 and the top is defined by a corresponding recess 68 in the burner cap 15 (See FIG. 4). The recess 68 provides increased ignition chamber volume and a proper gap for a spark. A chamber port 70 in the back of the u-shaped wall allows fluid communication between the main fuel chamber 60 and ignition chamber 55. Side ports 75 allow fluid communication with adjacent flame ports 80 and the ignition chamber 55.

Figure 4:
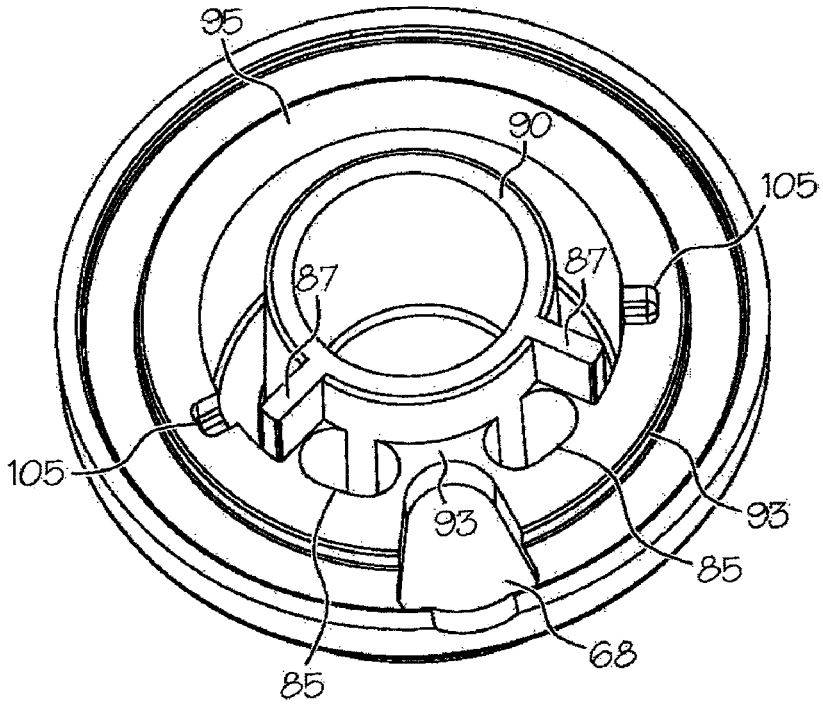
FIG. 4 illustrates an underneath side of a burner cap in accordance with an aspect of the present invention.

Turning now to FIG. 4, an underneath side of the burner cap 15 is shown in greater detail in accordance with an aspect of the present invention. The burner cap 15 includes at least one flame-stabilization chamber 85. In the present example, two flame-stabilization chambers 85 are provided. The flame-stabilization chambers 85 have a somewhat flattened cylindrical configuration and are located at the underside of the burner cap 15 approximately midway between the circumference of the burner cap 15 and the center of the burner cap 15. Each flame-stabilization chamber 85 is defined by a leg 87, a portion of a first annular wall 90, and a rib portion 93 of the burner cap 15. These elements 87, 90, 93 serve to somewhat isolate the flame-stabilization chambers 85 from any pressure disturbance that impacts the burner flame. As a result, the gas-air mixture that is contained within the flame-stabilization chambers 85 will be available to stabilize the flame output of the burner in the event of such a pressure disturbance. It is to be appreciated that any other suitable structure or structures can be provided to facilitate isolation of the flame-stabilization chambers from pressure disturbances.

The first annular wall 90 of the burner cap 15 is significantly larger in diameter than the annular boss 17 of the burner body 10 and is used for directing the fuel flowing from the annular boss 17 of burner body 10 (FIG. 3) into the main fuel chamber 60. A second annular wall 95 spaced radially outward from the first annular wall 90 is provided to contact the crossover spacers 40 extending from the burner teeth 35 to form the crossover slots 45, as shown in FIG. 2. One or more recessed portions 105 can also be provided in the burner cap 15 in a location(s) that corresponds with the one or more locators 50 projecting from the burner body 10. It is to be appreciated that the burner cap 15 can include the locator projections while the burner body includes the corresponding recessed portions. It is to be further appreciated that any suitable structure or mechanism can be employed to facilitate proper orientation of the cap 15 on the burner body 10. Proper orientation of the cap 15 on the burner body 10 is such that the flame-stabilization chamber 85 of the cap 15 corresponds with the flame-stabilization chamber 55 of the body 10.

Figure 5:
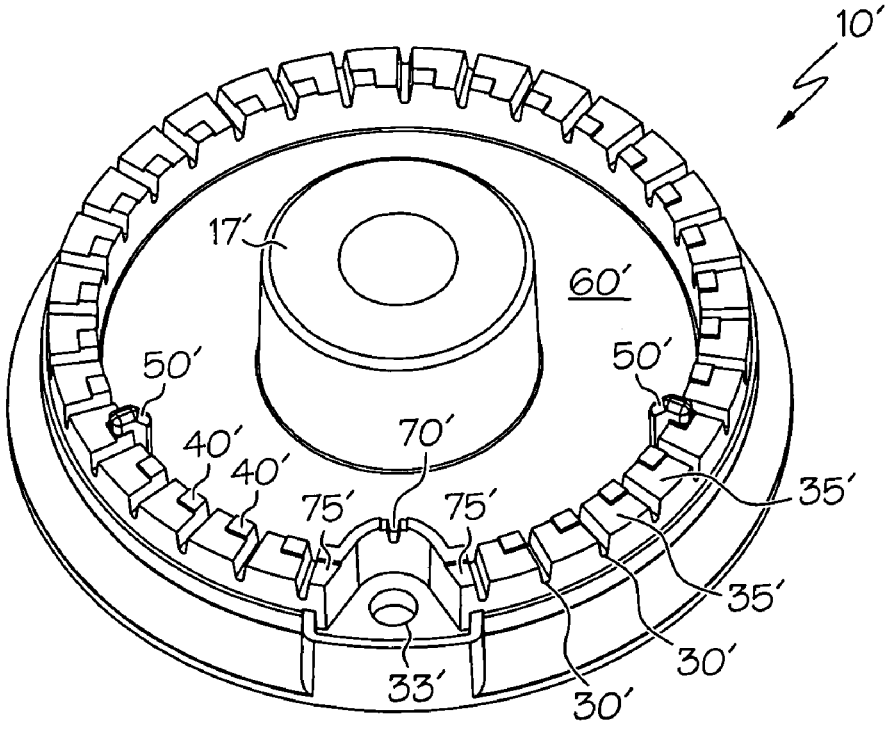
FIG. 5 illustrates a top side of another burner body in accordance with an aspect of the present invention.
Figure 6:
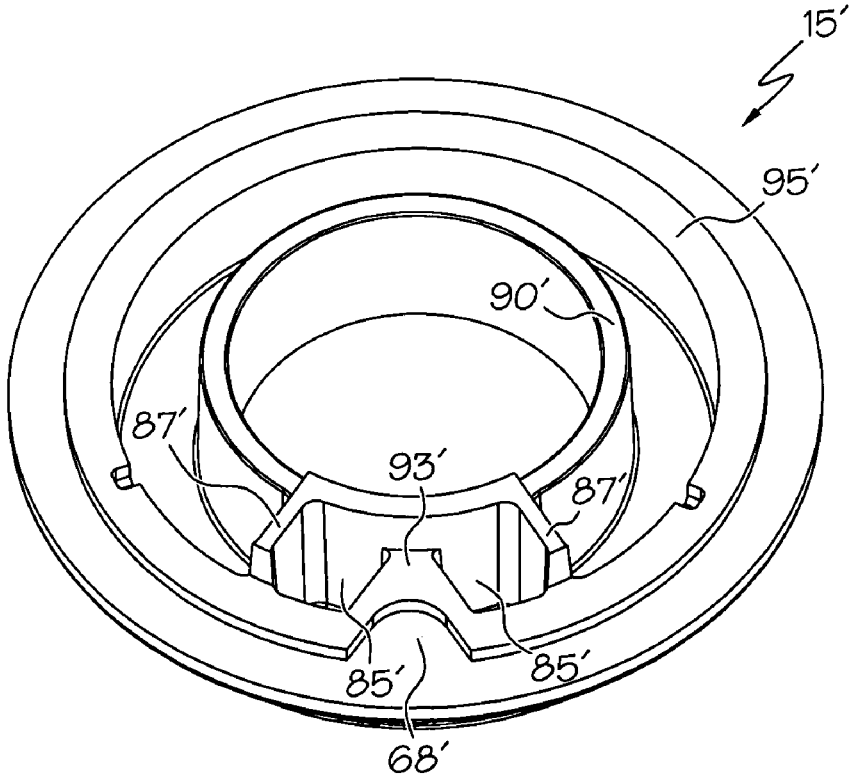
FIG. 6 illustrates an underneath side of another burner cap in accordance with an aspect of the present invention.

Turning now to FIGS. 5-8, other examples of burner bodies and burner caps are shown in accordance with an aspect of the present invention. Turning to FIGS. 5 and 6, to the extent that burner body 10' and burner cap 15' are provided with components having identical, similar or analogous structures and/or functions as that of burner body 10 and burner cap 15 of FIGS. 3 and 4, like reference numerals, augmented by a prime ' will be employed. Burner cap 15' includes two flame-stabilization chambers 85' provided on an underside thereof. The flame-stabilization chambers 85' are roughly square in cross-section and are located approximately midway between the circumference of the burner cap 15' and the center of the burner cap 15'. The flame-stabilization chambers are partially enclosed by legs 87' and a portion of the first annular wall 90'. When the burner cap 15 is coupled to the burner body 10, the legs 87' and first annular wall 90' will extend to near the bottom of the annular recess defined by the burner cap 15' and burner body 10' that holds the fuel-air mixture so that the flame-stabilization chambers 85' will be somewhat isolated from any pressure disturbance that impacts the burner flame. Consequently, the fuel-air mixture that is contained in the flame-stabilization chambers will be available to stabilize the flame when such a pressure disturbance occurs.

Figure 7:
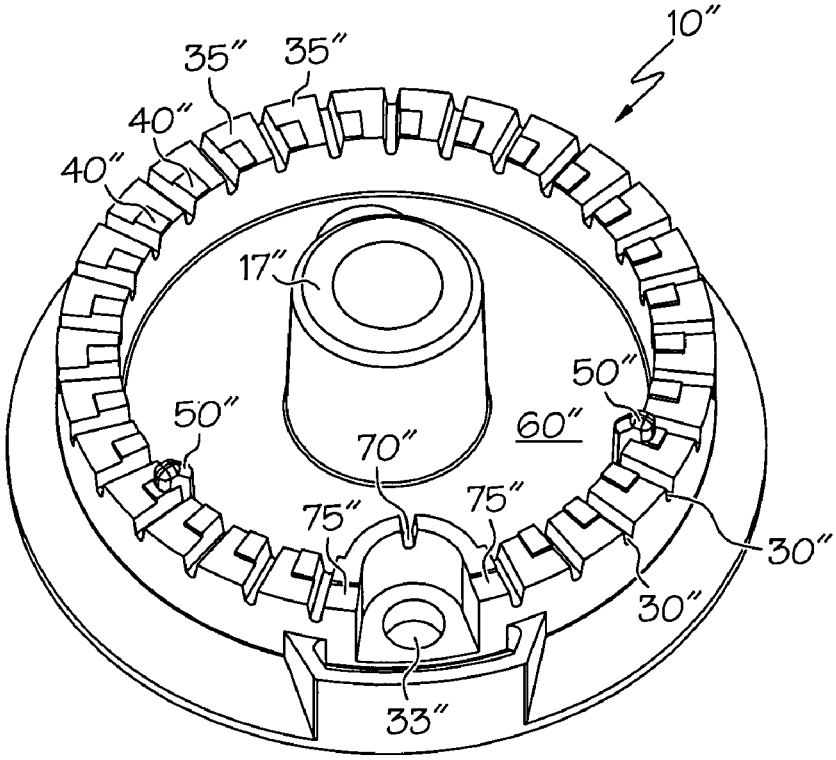
FIG. 7 illustrates a top side of yet another burner body in accordance with an aspect of the present invention.
Figure 8:
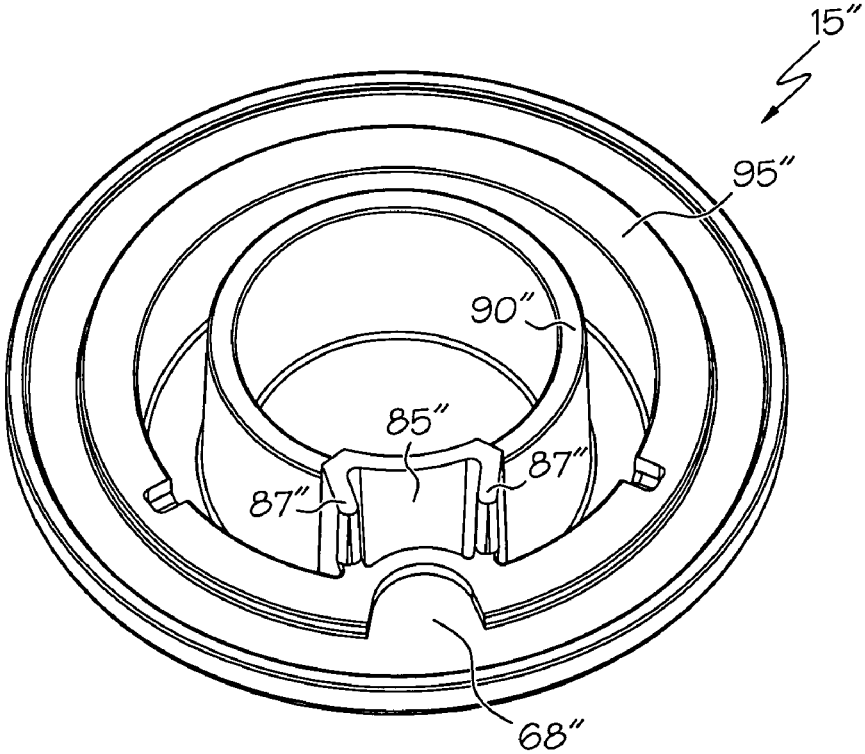
FIG. 8 illustrates an underneath side of yet another burner cap in accordance with an aspect of the present invention.

Turning now to FIGS. 7 and 8, to the extent that burner body 10" and burner cap 15" are provided with components having identical, similar or analogous structures and/or functions as that of burner body 10 and burner cap 15 of FIGS. 3 and 4, like reference numerals, augmented by a double prime " will be employed. In the example shown in FIG. 8, a single flame-stabilization chamber 85" is provided in the burner cap 15". The flame-stabilization chamber 85" has a roughly u-shaped configuration and is located at an underside of the burner cap 15" approximately midway between the circumference of the burner cap 15" and the center of the burner cap 15". The longer side of the u-shaped flame-stabilization chamber 85" is arranged generally concentrically with the circumference of the burner cap 15 and the open side of the u-shaped flame-stabilization chamber 85" faces the circumference of the burner cap 15". The longer side and the side legs of the u-shaped flame-stabilization chamber 85", when the burner cap 15" is coupled to the burner body 10", will extend to near the bottom of the annular recess defined between the burner cap 15" and the burner body 10" that retains a supply of the fuel-air mixture so that the fuel-stabilization chamber 85" will be somewhat isolated from any pressure disturbance that impacts the burner flame. The fuel-air mixture that is contained within the flame-stabilization chamber 85" will be available to stabilize the flame when such a pressure disturbance occurs.

Figure 9:
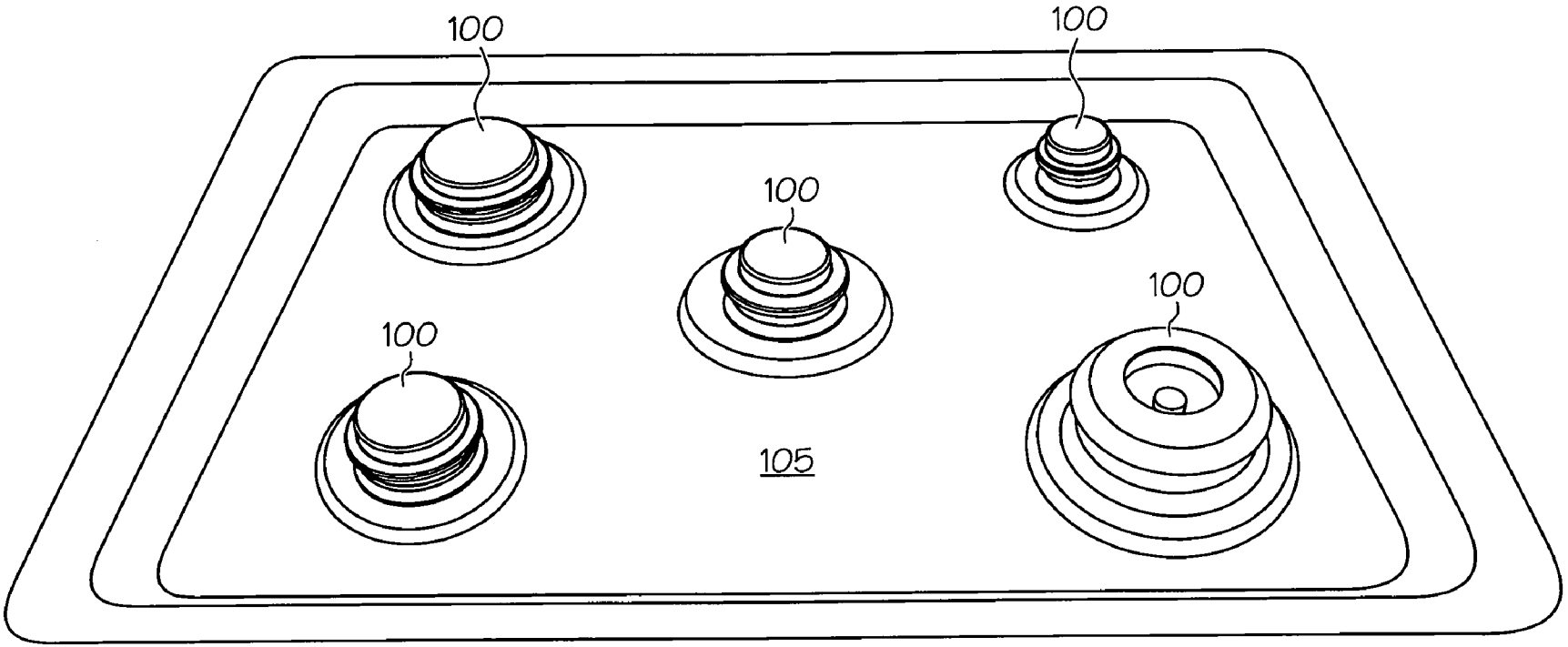
FIG. 9 illustrates an example of a cooktop employing a plurality of burner assemblies in accordance with an aspect of the present invention.

As shown in FIG. 9, a plurality of burner assemblies 100 of various sizes, shapes, and configurations can be mounted on a support surface 105 of a gas cooking appliance, for example, such as a range or a cooktop. The cap is disposed over the top of burner body and can contact and rest upon crossover spacers, as described above, or can be fixedly attached to a sidewall or other designated attachment point. In operation, a control knob on the gas cooking appliance which corresponds to the desired gas burner assembly is manipulated, thereby causing a valve to provide fuel to gas feed conduit. The fuel is discharged from an injection orifice and primary air is entrained to support combustion. The gas-air mixture flows through the annular boss of the burner orifice to the main fuel chamber and then to the portions of the burner body and burner cap, as discussed above.

What has been described above includes example implementations of the present invention. It is, of course, not possible to describe every conceivable combination of components or methodologies for purposes of describing the present invention, but one of ordinary skill in the art will recognize that many further combinations and permutations of the present invention are possible. For instance, while one type of burner is described and illustrated, the instant invention is applicable to other types of burners, such as stamped aluminum burners and separately mounted orifice burners. Accordingly, the present invention is intended to embrace all such alterations, modifications and variations of the present invention.

It should be evident that this disclosure is by way of example and that various changes may be made by adding, modifying or eliminating details without departing from the scope of the teaching contained in this disclosure. The invention is therefore not limited to particular details of this disclosure except to the extent that the following claims are necessarily so limited.

The invention claimed is:

1. A gas burner cap for a cooking appliance comprising:

a top side and a bottom side, the bottom side being configured to face a corresponding burner body, the burner body including a plurality of flame ports;

a recess located on the bottom side of the cap, the recess configured to correspond with a position of an ignition chamber in the corresponding burner body;

at least one flame-stabilization chamber located on the bottom side of the cap and positioned so that when the burner cap is coupled to the corresponding burner body, the at least one flame-stabilizing chamber is positioned radially inward of the flame ports and is isolated from the flame ports; and at least one solid leg portion to facilitate isolation of the at least one flame-stabilization chamber from pressure disturbances when the burner cap is coupled to the corresponding burner body.

2. The gas burner cap of claim 1, further comprising at least two flame-stabilization chambers.

3. The gas burner cap of claim 1, wherein the at least one flame-stabilization chamber is positioned above a main fuel chamber in the burner body.

4. The gas burner cap of claim 1, wherein the at least one flame-stabilization chamber is somewhat isolated from pressure disturbances that impacts a burner flame when the burner cap is coupled to a corresponding burner body.

5. The gas burner cap of claim 1, further comprising at least one leg portion to facilitate isolation of the flame-stabilization chamber from pressure disturbances when the burner cap is coupled to a corresponding burner body.

6. The gas burner cap of claim 1, further comprising an annular wall spaced radially inward from the at least one flame-stabilization chamber to facilitate isolation of the at least one flame-stabilization chamber from pressure disturbances when the burner cap is coupled to a corresponding burner body.

7. The gas burner cap of claim 1, further comprising an annular wall to facilitate isolation of the at least one flame-stabilization chamber from pressure disturbances when the burner cap is coupled to a corresponding burner body.

8. The gas burner cap of claim 1, wherein the at least one flame-stabilization chamber is of a flattened cylindrical configuration.

9. The gas burner cap of claim 1, wherein the at least one flame-stabilization chamber is of a u-shaped configuration.

10. The gas burner cap of claim 1, wherein the at least one flame-stabilization chamber has a square cross-section.

11. A gas burner assembly for a cooking appliance comprising:

a burner body having a top side and a bottom side, the burner body including a plurality of flame ports provided through a sidewall of the burner body;

a burner cap having a top side and a bottom side, the bottom side of the cap being configured to couple with the top side of the burner body, and an ignition chamber, wherein a bottom of the ignition chamber is defined by a surface of the burner body and a top of the ignition chamber is defined by a corresponding recess in the burner cap, wherein the burner cap includes at least one flame-stabilization chamber and at least one solid leg portion, the at least one flame-stabilization chamber being configured to retain a gas-air mixture therein, that least one flame stabilization chamber being located on the bottom side of the cap and positioned so that when the burner cap is coupled to the corresponding burner body, the at least one flame-stabilizing chamber is positioned radially inward of the flame ports and is isolated from the flame ports, and the at least one leg portion being configured to facilitate isolation of the at least one flame-stabilization chamber from pressure disturbances when the burner cap is coupled to the corresponding burner body.

12. The gas burner assembly of claim 11, wherein the burner cap includes two flame-stabilization chambers provided within the cap.

13. The gas burner assembly of claim 11, wherein the burner cap includes two solid leg portions and a wall portion to facilitate isolation of the at least one flame-stabilization chamber from pressure disturbances when the burner cap is coupled to the burner body.

14. The gas burner assembly of claim 11, wherein at least one of the burner body and burner cap includes a locator and the other of the burner body and the burner cap includes a recessed portion for receiving the locator.

15. The gas burner assembly of claim 11, wherein the burner body further includes a plurality of flame ports provided through a sidewall of the burner body.

16. The gas burner assembly of claim 11, wherein the burner body further includes an ignition chamber for receiving a spark electrode.

17. The gas burner assembly of claim 11, further comprising a support member for receiving an orifice fitting and a spark ignition assembly.

18. The gas burner assembly of claim 11, wherein the burner body includes crossover spacers extending past the top surface of burner teeth.

19. The gas burner assembly of claim 11, further comprising at least one locator configured to orient the cap on the burner body such that the recess of the cap corresponds with the ignition chamber of the body.

* * * * *